US005154336A

United States Patent [19]

Ouellet

[11] Patent Number: 5,154,336

[45] Date of Patent: Oct. 13, 1992

[54] DISPENSER FOR WIRE MARKERS

[76] Inventor: Jean-Louis Ouellet, 783 Caplan, Granby (Québec), Canada, J2G 8C9

[21] Appl. No.: 746,315

[22] Filed: Aug. 16, 1991

[51] Int. Cl.[5] ..... B26F 3/02

[52] U.S. Cl. ..... 225/38; 225/52; 225/53; 225/78

[58] Field of Search ..... 225/34, 38, 39, 46, 225/52, 53, 77, 78; 206/303, 499, 509, 389; 242/55.3, 55.42, 55.53

[56] References Cited

U.S. PATENT DOCUMENTS

| | | | |
|---|---|---|---|
| 2,771,214 | 11/1956 | Lefebvre | 225/53 X |
| 3,035,345 | 5/1962 | Barnard | 225/53 X |
| 3,502,252 | 3/1970 | Mariani | 225/38 X |
| 4,200,249 | 4/1980 | Synstelien et al. | 242/96 |
| 4,262,835 | 4/1981 | Wrobel | 225/38 X |
| 4,527,722 | 7/1985 | Strachan | 225/34 X |
| 4,530,472 | 7/1985 | Voss et al. | 225/34 X |
| 4,574,979 | 3/1986 | Hackett | 225/34 X |
| 4,586,671 | 5/1986 | Piana et al. | 206/389 X |
| 4,998,685 | 3/1991 | Spencer | 242/137 |

*Primary Examiner*—Frank T. Yost
*Assistant Examiner*—Eugenia A. Jones
*Attorney, Agent, or Firm*—Collard & Roe

[57] ABSTRACT

A dispenser is provided for wire markers that are detachably linked to one another by breakable connections, thereby forming a chain of wire markers. The dispenser comprises a casing including two parallel generally flat side walls that are substantially perpendicular to a central axis of the casing; a peripheral wall disposed between the side walls and around the central axis, forming with the side walls a housing for receiving a portion of the chain of wire markers; a channel having an inlet in communication with the housing, an outlet facing away from the casing, and having an inner section providing a frictional contact which opposes against free movement of a portion of the chain of wire markers through the channel, the outlet having a substantially sharp edge for breaking the connections between the wire markers; and an opening located along a section of the channel by which a user can drive the chain of wire markers from the housing to the outlet, whereby the user can drive the chain of wire markers through the channel and individually dispense the wire markers by breaking the connections by means of the sharp edge.

8 Claims, 3 Drawing Sheets

DISPENSER FOR WIRE MARKERS

FIELD OF THE INVENTION

A dispenser is provided for wire markers that are detachably linked to one another by breakable connections, thereby forming chain of wire markers.

More precisely, the dispenser is especially designed for muff or jaw type wire markers.

BACKGROUND OF THE INVENTION

Some of the most common used devices acting as wire marker dispensers are boxes or racks, which are rather adapted for storing the wire markers instead of dispensing these. For a user, such dispensers are not very handy when time comes to work on a ladder or in a tight place for instance, where there is no convenient space to lay down the dispenser at an arm range. Also with such dispensers, usually no means is provided to help breaking the connections between the wire markers, so the user has to provide its own one if desired.

To improve the situation, some users make do and mend their own dispenser, often resulting in a rod arrangement which can be attached to the user, and whereby wire markers are disposed along. Such arrangement does not provide any protection to the wire markers so they can get dirty or be caught on any surrounding object. Furthermore, the use of such dispenser is time-consuming since it is adapted to carry the wire markers more than to dispense these.

Known in the art is U.S. Pat. No. 4,530,472 to VOSS et al, granted on July 23, 1985. This patent describe a wire marker dispenser for dispensing tape for marking wire. Since the wire markers in this patent are tape spools, the dispenser's casing is provided with a plurality of side openings with mountings to hold the spools, and offset guides corresponding to the openings whereby the tape is dispensed. This dispenser is not adapted at all to be used in any way for dispensing the present wire markers forming a chain.

Also known in the art is U.S. Pat. No. 4,200,249 to SYNSTELIEN et al, granted on Apr. 29, 1980. This patent describes a storage device for strand, including a case having a cylindrical housing provided with an axle for receiving a bobbin. The device can be secured to a belt or a strap by means of a hook. However, apart from dispensing wire, it is not adapted at all to be used in any way for dispensing the present wire markers forming a chain.

OBJECT OF THE INVENTION

An object of the present invention is to provide a dispenser for wire markers that are detachably linked to one another by breakable connections, thereby forming a chain of wire markers, which is more efficient, time saving, and handy for dispensing such wire markers than the dispensers known in the art.

SUMMARY OF THE INVENTION

According to the present invention, there is provided a dispenser for wire markers that are detachably linked to one another by breakable connections, thereby forming a chain of wire markers, said dispenser comprising a casing including:

two parallel generally flat side walls that are substantially perpendicular to a central axis of said casing;

a peripheral wall disposed between the side walls and around said central axis, forming with said side walls a housing for receiving a portion of said chain of wire markers;

a channel having an inlet in communication with said housing, an outlet facing away from said casing, and having an inner section providing a frictional contact which opposes against free movement of a portion of said chain of wire markers through said channel, said outlet having a substantially sharp edge for breaking the connections between the wire markers; and means located along a section of said channel by which a user can drive said chain of wire markers from said housing to said outlet, whereby the user can drive said chain of wire markers through said channel and individually dispense said wire markers by breaking said connections by means of said sharp edge.

BRIEF DESCRIPTION OF THE DRAWINGS

The invention, as well as its numerous advantages, will be better understood by the following non-restrictive description of preferred embodiments made in reference to the appended drawings in which.

DESCRIPTION OF A PREFERRED EMBODIMENT OF THE INVENTION

Figure 1:
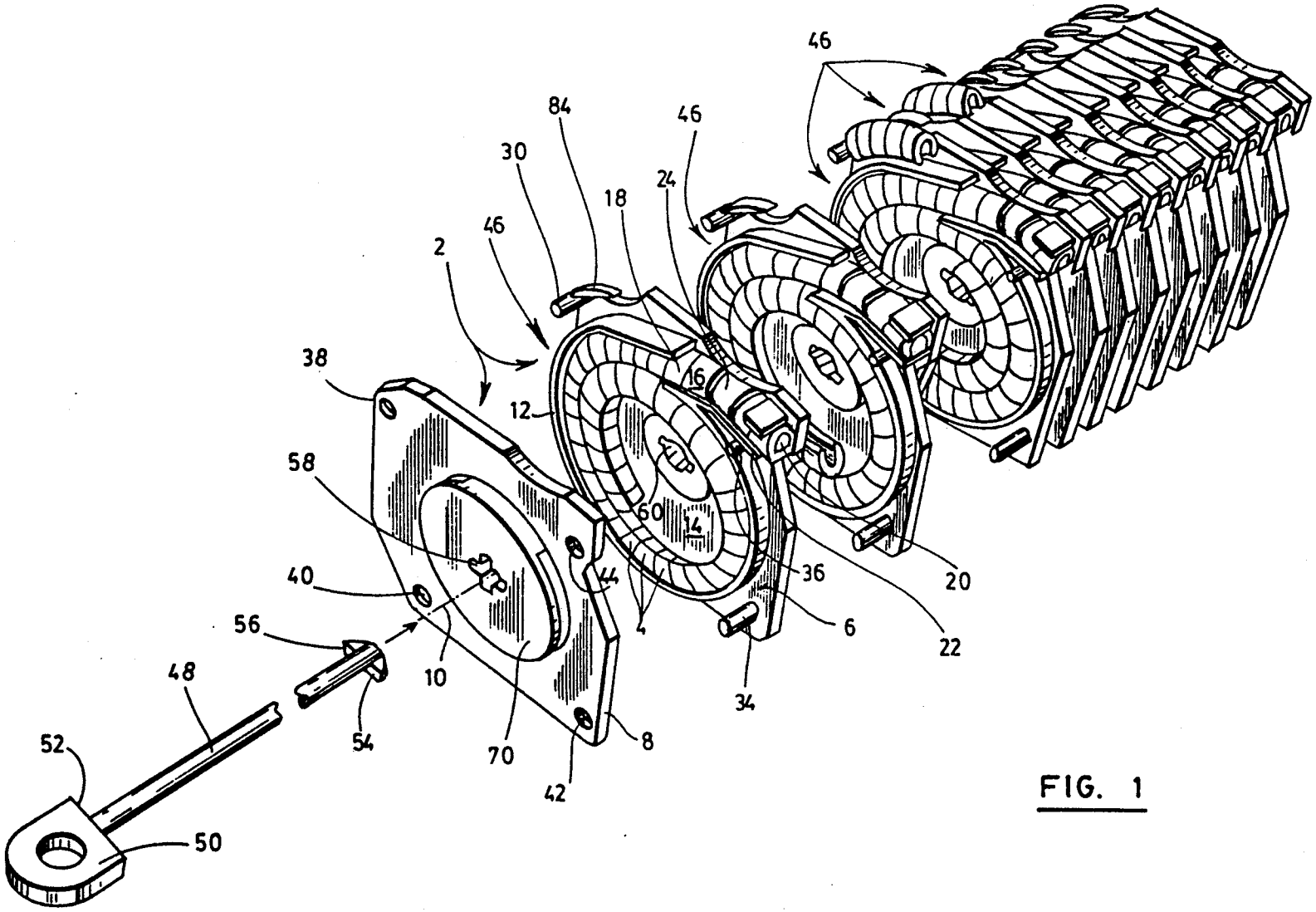
FIG. 1 is a perspective view of several juxtaposed dispensers for wire markers according to the present invention.

In the following description and in the drawings, same numerals are referring to same elements.

Referring now to FIG. where a set of juxtaposed dispensers are shown, each of the dispensers 2 is provided for wire markers 4 that are detachably linked to one another by breakable connections, thereby forming a chain of wire markers 4. Each dispenser 2 comprises a casing which includes two parallel flat side walls 6 and 8 that are perpendicular to a central axis 10 of the casing, and a peripheral wall 12 disposed between the side walls 6 and 8 and around the central axis 10. A housing 14 is so formed by putting together the side walls 6 and 8 and the peripheral wall 12, for receiving a portion of the chain of wire markers 4 to store in the dispenser 2. The casing also includes a channel 16 which has an inlet 18 in communication with the housing 14, and an outlet 20 facing away from the casing. The inner section of the channel 16 provides a frictional contact which opposes against free movement of a portion of the chain of wire markers 4 inside the channel 16, requiring that a particular strain has to be applied on the wire markers 4 to move them inside the channel 16. An opening 24, located along a section of the channel 16, gives access to the chain of wire markers 4 and allows a user to drive the chain of wire markers 4 from the housing 14 to the outlet 20 for individually dispense the wire markers 4. To achieve this goal, the outlet 20 has a sharp edge 22 to ease breaking the connections between the wire markers 4.

Figure 2:
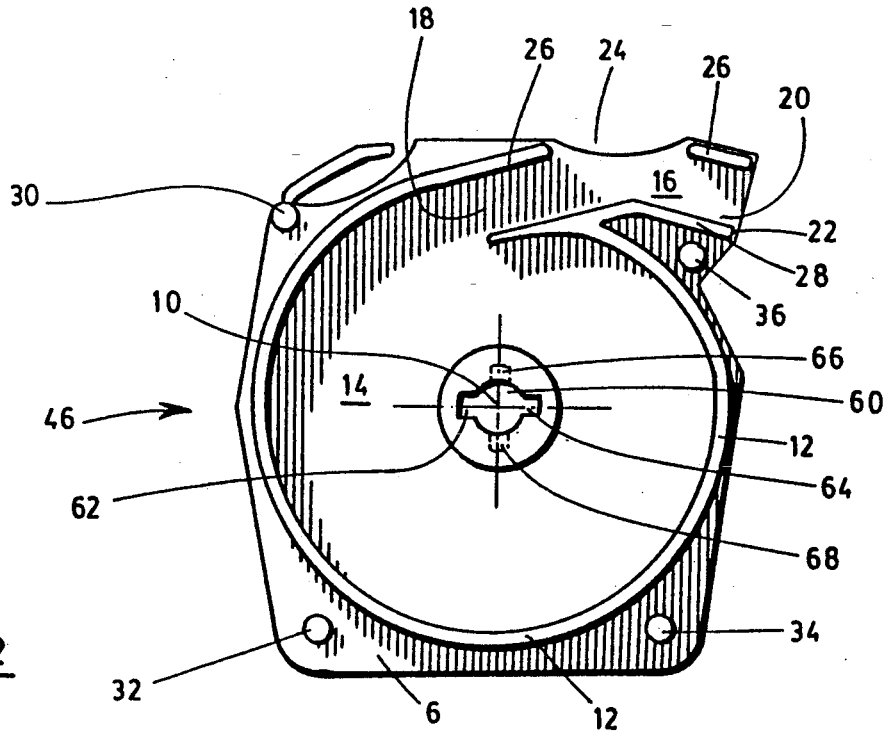
FIG. 2 is a side view showing the integral part of one of the dispenser shown in FIG. 1.

Referring now to FIG. 2, the peripheral wall 12 has an inner contour forming a spire coaxially centered with the central axis 10. The spire as an opening corresponding to the inlet 18 of the channel 16 facing in a direction which is tangential to the peripheral wall 12 so that the chain of wire markers 4 follows the inner contour of the peripheral wall 12 when passing from the channel 16 to the housing 14, guiding thereby the chain of wire markers 4 in a spiral path inside the housing 14.

The channel 16 is defined by the two side walls 6 and 8 (shown in FIG. 3) of the casing and a pair of parallel walls 26 and 28 extending from the opening of the spire, which forms the inlet 18 of the channel. The opening 24 in the wall 26 give access to the portion of the chain of wire markers 4 inside the channel 16 for sliding the wire markers 4 out of the dispenser 2 (shown in FIG. 1) by a finger thrust.

To ease sliding the wire markers 4 out, the section of the channel 16 where the opening 24 is located is concavely arched with respect to the central axis 10. Thus, the accessible portion of the chain of wire markers 4 is prominent of the channel 16 and offers better hold, spaces thereby produced between the wire markers 4 also helping.

Figure 3:
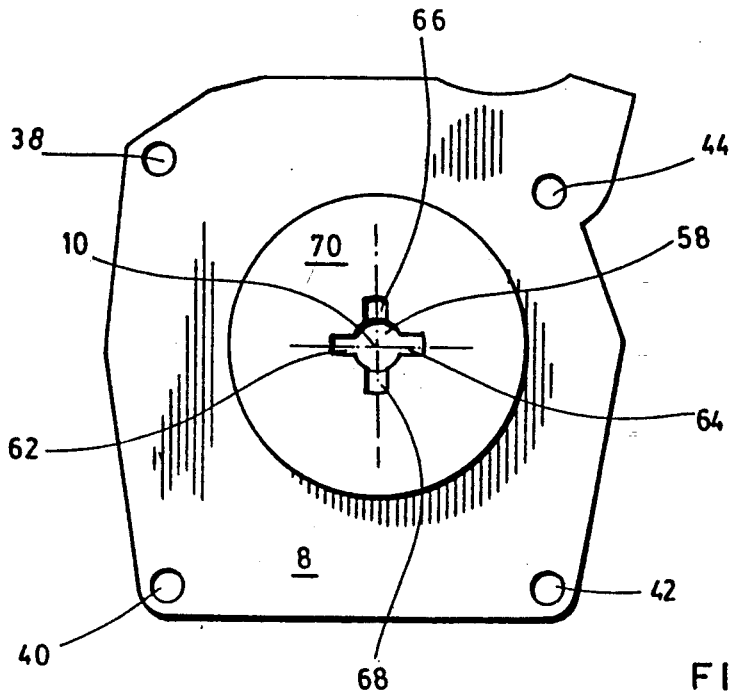
FIG. 3 is a side view showing the side wall acting as a lid for the dispensers shown in FIG. 1.

Referring now to FIGS. 2 and 3, the peripheral wall 12 and the channel 16 form an integral part 46 with the side wall 6. The other side wall 8 forms a removable lid 8. The side wall 6 is provided with four pins 30, 32, 34 and 36 projecting perpendicularly thereof for, when respectively engaged in operatively associated holes 38, 40, 42 and 44 in the lid 8, preventing rotational movement between the integral part 46 and the lid 8 with respect to the central axis 10, and detachably fixing the lid 8 to the integral part 6.

So far, it can be easily seen that the dispenser could be rather mould in one integral part instead of two parts as above-mentioned.

Referring now to FIG. 1, each dispenser 2 is secured by a cylindrical rod 48 which squeezes the lid 8 with the integral parts 46. The rod 48 is provided with a handle 50 having a shape forming a stop 52, and a pair of hooks 54 and 56 perpendicular to the rod 48 and extending thereof in opposite directions. A hole in the handle 50 allows the dispenser 2 to be hung to something or someone.

Referring now to FIGS. 1, 2 and 3, the lid 8 and each side wall 6 have respectively a central portion with an aperture 58 and 60 coaxially aligned with the central axis 10 and defining a substantially circular opening with two slots 62 and 64 radially projecting thereof in opposite directions. The rod 48 can be engaged in the apertures 58 and 60 only when the hooks 54 and 56 are aligned with the slots 62 and 64.

Referring to FIG. 2, the central portion of the side wall 6 has an outer surface provided with two recesses 66 and 68 radially projecting from the aperture 60 in opposite directions perpendicular to the slots 62 and 64.

Back to FIG. 1, the central portion of the lid 8 forms a prominent flexible part 70. The lid 8 is secured with the integral part 46 by passing the hooks 54 and 56 of the rod 48 first through the aperture 58 of the lid 8 and second through the aperture 60 of the integral part 56, until the stop 52 of the handle 50 is in abutment against the flexible part 70. At this point, a pressure has to be applied on the flexible part 70 so that the hooks 54 and 56 stick out of the outer surface of the integral part 46. By means of the handle 50, the pressure is applied on the flexible part 70 so that the hooks 54 and 56 can stick out and be fitted into the recesses 66 and 68. Of course, the length of the rod is predetermined according to the number of juxtaposed dispensers so that all the dispensers are tightly secured together.

By providing the lid 8 with two recesses 66 and 68 (shown in FIG. 3), the rod 4 can be either inserted in the juxtaposed dispensers 2 from the lid 8 or the side wall 6, and after locked by fitting its hooks 54 and 56 in the appropriate recesses 66 and 68 (shown in FIGS. 2 and 3) of the lid 8 or the integral part 46. This particularity is useful for adapting the dispenser 2 for a left or right-handed user.

Figure 4:
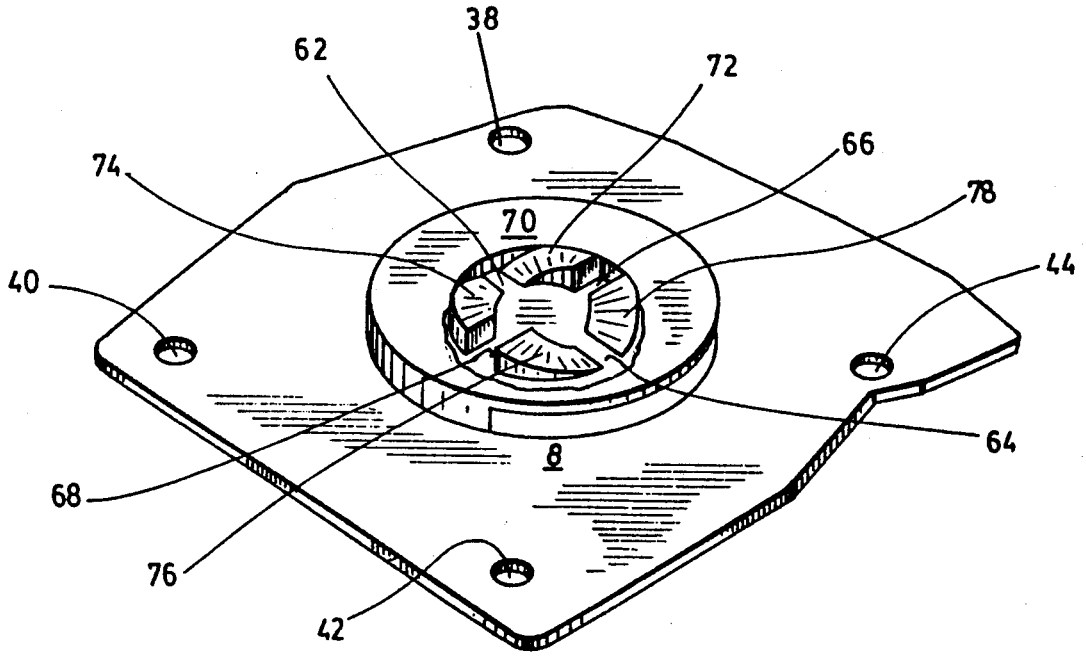
FIG. 4 is a perspective view showing another embodiment of the side wall acting as a lid in accordance with the present invention.

Referring now to FIG. 4, four ramps 72, 74, 76 and 78 are disposed respectively between the slots 62 and 64 and the recesses 66 and 68, each ramp 72, 74, 76 and 78 ascending from one of the slots 62 and 64 to an edge of the adjacent recess 66 and 68. These ramps 72, 74, 76 and 78 are useful in that, after that the rod 48 (shown in FIG. 1) has been inserted in the juxtaposed dispensers 2 (shown in FIG. 1). The user can rotate it so that the hooks 54 and 56 (shown in FIG. 1) are engaged on the adjacent ramps 72, 74, 76 and 78 thereby applying the necessary pressure on the flexible part 70 allowing to the hooks 54 and 56 (shown in FIG. 1) to get lodged in the recesses 66 and 68.

Back again to FIG. 1, each integral part 46 has an outer surface provided with holes located as in the lid 8, such that this outer surface is used as a lid for the adjacent integral part 46. A plurality of similar integral parts 46 can be juxtaposed by engaging the pins of one of the integral parts 46 in the corresponding holes of the outer surface of an adjacent integral part 46, and so on, the last of juxtaposed integral parts 46 being closed with the lid 8. The length of the rod 48 has to be adequately set with respect to the number of integral parts used, for securing them together.

The integral part 46 is provided with a projecting member 84 for holding some of the wire markers 4 waiting to be used. This projecting member 84 is mounted on the pin 30, although any outer section of the peripheral wall 12 could have been used, and projecting in a direction substantially tangential to the spire, between the side walls 6 and 8.

Although, the present invention has been explained hereinabove by way of a preferred embodiment thereof, it should be pointed out that any modifications to this preferred embodiment, within the scope of the appended claims is not deemed to changer or alter the nature and scope of the present invention.

What is claimed is:

1. Dispenser for wire markers that are detachably linked to one another by breakable connections, thereby forming a chain of wire markers, said dispenser comprising a casing including:

two parallel generally flat side walls that are substantially perpendicular to a central axis of said casing;

a peripheral wall disposed between the side walls and around said central axis, forming with said side walls a housing for receiving a portion of said chain of wire markers;

a channel having an inlet in communication with said housing, an outlet facing away from said casing, and having an inner section providing a frictional contact which opposes against free movement of a portion of said chain of wire markers through said channel, said outlet having a substantially sharp edge for breaking the connections between the wire markers, said channel being concavely arched with respect to said central axis so that spaces are produced between adjacent wire markers; and means located along a section of said channel by which a user can drive said chain of spaced wire markers from said housing to said outlet, whereby the user can drive said chain of spaced wire markers through said channel and individually dispense said spaced wire markers by breaking said connections by means of said sharp edge.

2. The dispenser according to claim 1, wherein said peripheral wall has an inner contour forming a spire coaxially centered with said central axis, said spine having an opening facing in a direction substantially tangential to said peripheral wall, said channel being defined by the two side walls of said casing and a pair of substantially parallel walls extending from the opening of said spire whereby the chain of wire members inside said housing follows a spiral path.

3. The dispenser according to claim 2, wherein said channel has walls; and wherein said means by which a user can drive the chain of wire markers is an opening through one of said walls of said channel, said chain of wire markers having thereby an accessible portion inside said channel for sliding out the wire markers by a finger thrust.

4. The dispenser according to claim 2, wherein said peripheral wall and said channel form an integral part with one of said side walls, the other side wall acting as a removable lid, the side wall of said integral part having a plurality of pins projecting perpendicularly thereof for, when respectively engaged in operatively associated holes in said lid, preventing rotational movement between said integral part and said lid with respect to said central axis, and detachably fixing said lid to said integral part.

5. The dispenser according to claim 4, wherein said integral part is provided with a projecting member for holding some of said wire markers, said projecting member being mounted on an outer section of said peripheral wall and projecting in a direction substantially tangential to said spire.

6. Dispenser for wire markers that are detachably linked to one another by breakable connections, thereby forming a chain of wire markers, said dispenser comprising a casing including:

two parallel generally flat side walls that are substantially perpendicular to a central axis of said casing;

a peripheral wall disposed between the side walls and around said central axis, forming with said side walls a housing for receiving a portion of said chain of wire markers; said peripheral wall has an inner contour forming a spire coaxially centered with said central axis, said spire having an opening facing in a direction substantially tangential to said peripheral wall;

a channel having an inlet in communication with said housing, an outlet facing away from said casing, and having an inner section providing a frictional contact which opposes against free movement of a portion of said chain of wire markers through said channel, said outlet having a substantially sharp edge for breaking the connections between the wire markers, said channel being defined by the two side walls of said casing and a pair of substantially parallel walls extending from the opening of said spire, whereby the chain of wire markers inside said housing follows a spiral path, said peripheral wall and said channel form an integral part with one of said side walls, the other side wall acting as a removable lid, the side wall of said integral part having a plurality of pins projecting perpendicularly thereof for, when respectively engaged in operatively associated holes in said lid, preventing rotational movement between said integral part and said lid with respect to said central axis, and detachably fixing said lid to said integral part;

means located along a section of said channel by which a user can drive said chain of wire markers from said housing to said outlet, whereby the user can drive said chain of wire markers through said channel and individually dispense said wire markers by breaking said connections by means of said sharp edge; and a substantially cylindrical rod having a predetermined length, an end provided with a handle including a stop, and an opposite end provided with a pair of hooks perpendicular to said rod and extending thereof in opposite directions, said lid and the side wall of said integral part having respectively a central portion with an aperture coaxially aligned with said central axis and defining a substantially circular opening with two slots radially projecting thereof in opposite directions, whereby said rod can be engaged only when said hooks are aligned with said slots, at least one of said central portions having an outer surface provided with two recesses radially projecting from said aperture in opposite directions perpendicular to said slots, the central portion of said lid forming a prominent flexible part, whereby said lid may be secured with said integral part by passing the hooks of said rod through said apertures, applying a pressure on said flexible part so that said hooks can stick out of said outer surface, and rotating said rod by means of said handle so that said hooks are fitted into said recesses, the stop of said handle being in abutment against one of the side walls while said hooks being respectively in abutment in and against said recesses of the other of said side walls.

7. The dispenser according to claim 6, wherein said outer surface is also provided with four ramps which are disposed respectively between said slots and said recesses, each ramp ascending from one of said slots to an edge of the adjacent recess, whereby, after the hooks of said rod have been substantially stuck out of said outer surface, a user can rotate said rod by means of said handle so that said hooks are engaged on two of said ramps, thereby applying said pressure on said flexible part while the stop of said handle is in abutment against one of said side walls, until said hooks are lodged in said recesses.

8. The dispenser according to claim 6, wherein the side wall of said integral part has an outer surface provided with holes located as in said lid, such that said outer surface can be used as a lid for another similar integral part, whereby a plurality of similar integral parts can be juxtaposed by engaging the pins of one of said integral parts in the corresponding holes of said outer surface of another of said integral parts, the last of the juxtaposed integral parts being closed with said lid, the length of said rod being adequately set for securing said plurality of integral parts together.

* * * * *